US006920989B2

(12) United States Patent
Lin

(10) Patent No.: US 6,920,989 B2
(45) Date of Patent: Jul. 26, 2005

(54) BATHROOM RACK

(76) Inventor: Torng Yuh Lin, No. 124, Sec. 3, Wen Hua St., Kuei Jen Hsiang, Tainan Hsien (TW)

( * ) Notice: Subject to any disclaimer, the term of this patent is extended or adjusted under 35 U.S.C. 154(b) by 106 days.

(21) Appl. No.: 10/439,054

(22) Filed: May 14, 2003

(65) Prior Publication Data

US 2004/0226902 A1 Nov. 18, 2004

(51) Int. Cl.[7] ..... A97F 5/08
(52) U.S. Cl. ..... 211/87.01
(58) Field of Search ..... 211/87.01, 16, 211/85.12, 71.01, 85.31, 106, 126.9, 133.5, 181.1, 119.009, 88.01; D6/530

(56) References Cited

U.S. PATENT DOCUMENTS

D23,038 S * 2/1894 Wagandt ..... D6/534
D54,685 S * 3/1920 Salomon ..... D6/574
D72,804 S * 6/1927 Sharwood ..... D6/568
5,169,010 A * 12/1992 Fortner ..... 211/86.01
5,180,067 A * 1/1993 Conaway et al. ..... 211/119
5,289,927 A * 3/1994 Emery ..... 211/106
5,921,410 A * 7/1999 Emery et al. ..... 211/88.01
6,257,425 B1 * 7/2001 Liu ..... 211/90.01
6,334,541 B1 * 1/2002 Chang ..... 211/88.01
6,561,364 B1 * 5/2003 Brunsden ..... 211/90.01

* cited by examiner

*Primary Examiner*—Peter M. Cuomo
*Assistant Examiner*—Sarah Purol
(74) *Attorney, Agent, or Firm*—Pro-Techtor International Services

(57) ABSTRACT

A bathroom rack is constructed to include two end brackets fixedly fastened to the wall of a bathroom, each end bracket having a recessed receiving portion and a front extension arm, two rod members connected between plugholes in the front extension arms of the end brackets for hanging towels or the like, and a rack body connected between the end brackets for holding bottle items, the rack body having a L-shaped cross section, a plurality of drain holes in the bottom wall thereof, and two distal ends respectively press-fitted into the recessed receiving portions of the end brackets.

6 Claims, 9 Drawing Sheets

BATHROOM RACK

BACKGROUND OF THE INVENTION

1. Field of the Invention

The present invention relates to racks for holding things and, more particularly, to a bathroom rack, which is practical for use in a bathroom to hold towels, bottle items, cakes of soap, cups, and any of a variety of bathroom items.

2. Description of the Related Art

FIG. 1 illustrates a bathroom rack according to the prior art. According to this design, the bathroom rack comprises a plurality of rod members 10 connected in parallel between two end brackets for hanging towels 20. This structure of bathroom rack is not suitable for holding other bathroom items.

FIG. 2 illustrates another structure of bathroom rack according to the prior art. According to this design, the bathroom rack comprises a grille 40 for hanging different containers 30 for holding bottled bathroom items 50, toothpaste and brushes 60, and a plurality of hooks 401 provided at the bottom side of the grille 40 for hanging towels 20, wash balls 70, cups, etc. This structure of bathroom rack is not durable in use. When carried too much bathroom items, the grille 40 may be forced to drop from the wall.

FIGS. 3 and 4 show still another structure of bathroom rack according to the prior art. According to this design, the bathroom bracket comprises a channel bar 80 fixedly fastened to the wall for holding bottled bathroom items 50 or the like, two end caps 100 respectively fastened to the ends of the channel bar 80, and a rod member 90 connected between the end caps 100 and suspended in front of the channel bar 80 for hanging towels 20, wash balls 70, etc. This structure of bathroom rack is still not satisfactory in function. Because the channel bar 80 has a limited width between the front and back upright walls, it is inconvenient to drive screws 801 through the back upright wall into the wall of the bathroom. When the channel bar 80 covered with dust after a long use, it is difficult to clean the inside of the channel bar 80.

SUMMARY OF THE INVENTION

The present invention has been accomplished under the circumstances in view. It is one object of the present invention to provide a bathroom rack, which is durable in use. It is another object of the present invention to provide a bathroom rack, which is easy to install. It is still another object of the present invention to provide a bathroom rack, which is practical for holding any of a variety of bathroom items. It is still another object of the present invention to provide a bathroom rack, which is easy to clean. According to one aspect of the present invention, the bathroom rack comprises two end brackets fixedly fastened to the wall of a bathroom, the end brackets each comprising a recessed receiving portion and a front extension arm, the front extension arm having at least one plughole; at least one rod member connected between the end brackets, the at least one rod member each having two distal ends respectively press-fitted into one plughole of the front extension arm of each of the end brackets; and a rack body connected between the end brackets, the rack body comprising an elongated bearing plate, the elongated bearing plate having a L-shaped cross section, a plurality of drain holes in a bottom wall thereof, and two distal ends respectively press-fitted into the recessed receiving portion of each of the end brackets. Because the rack body is detachably connected between the end brackets, it can be removed from the wall for washing. According to another aspect of the present invention, a soap case and a brush case are respectively detachably coupled to one end bracket for holding a cake of soap and brushes.

DETAILED DESCRIPTION OF THE PREFERRED EMBODIMENT

Figure 1:
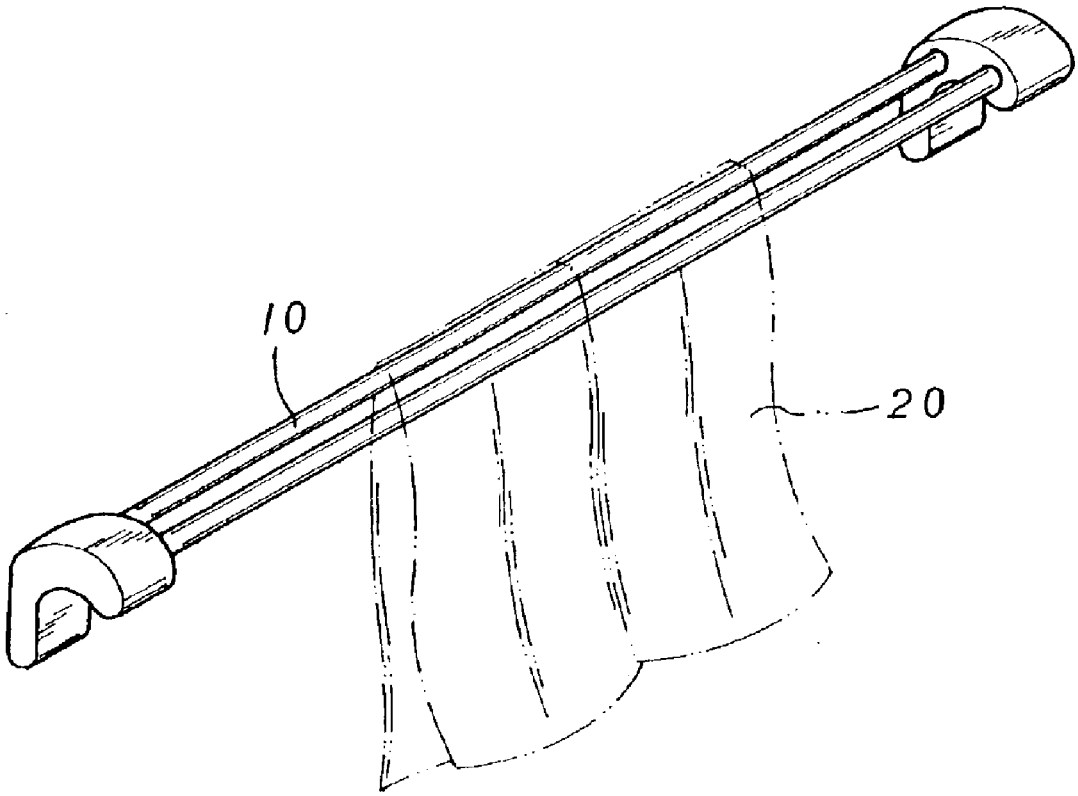
FIG. 1 (Prior Art)
FIG. 1 illustrates a bathroom rack according to the prior art.
Figure 2:
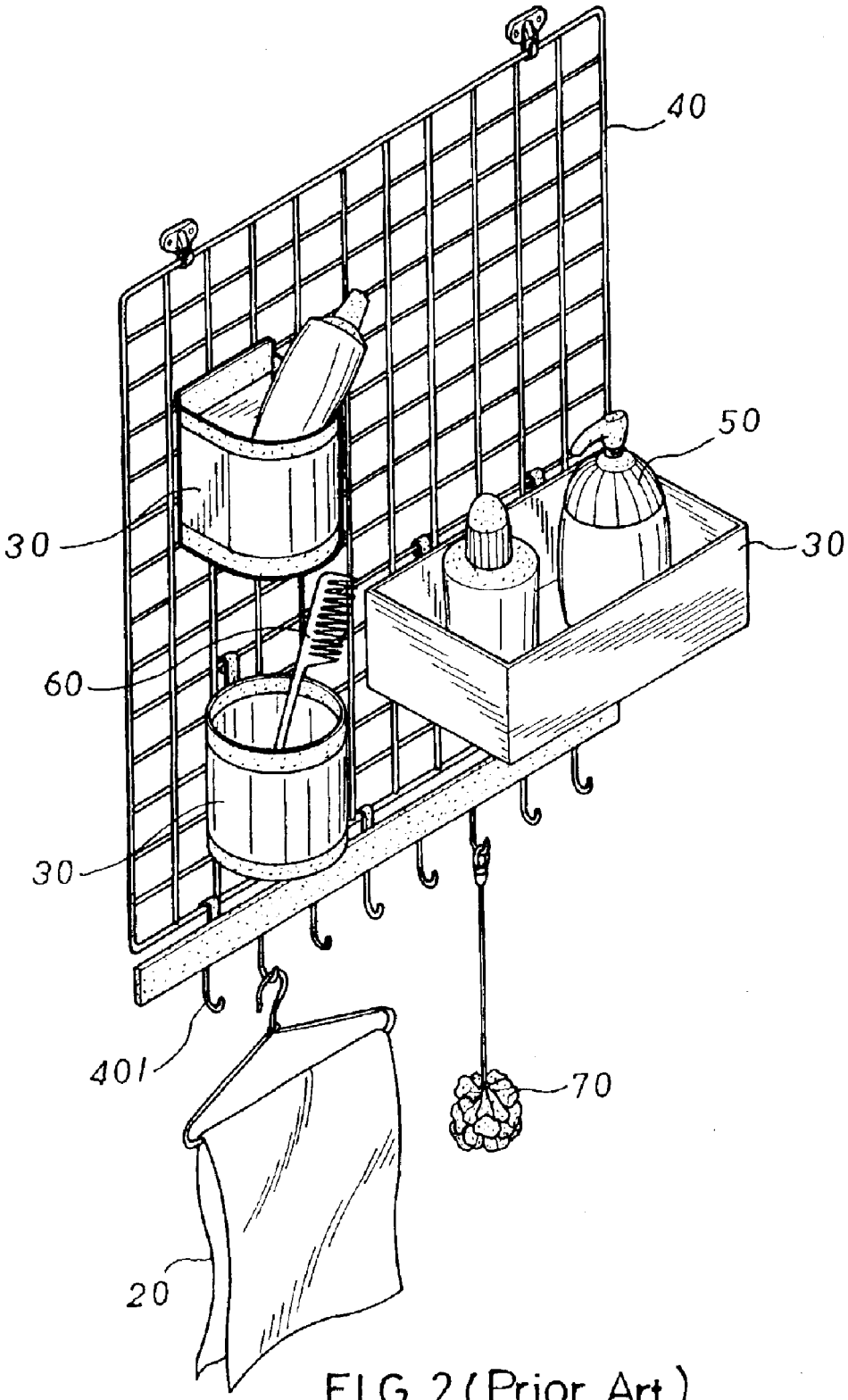
FIG. 2 (Prior Art)
FIG. 2 illustrates another structure of bathroom rack according to the prior art.
Figure 3:
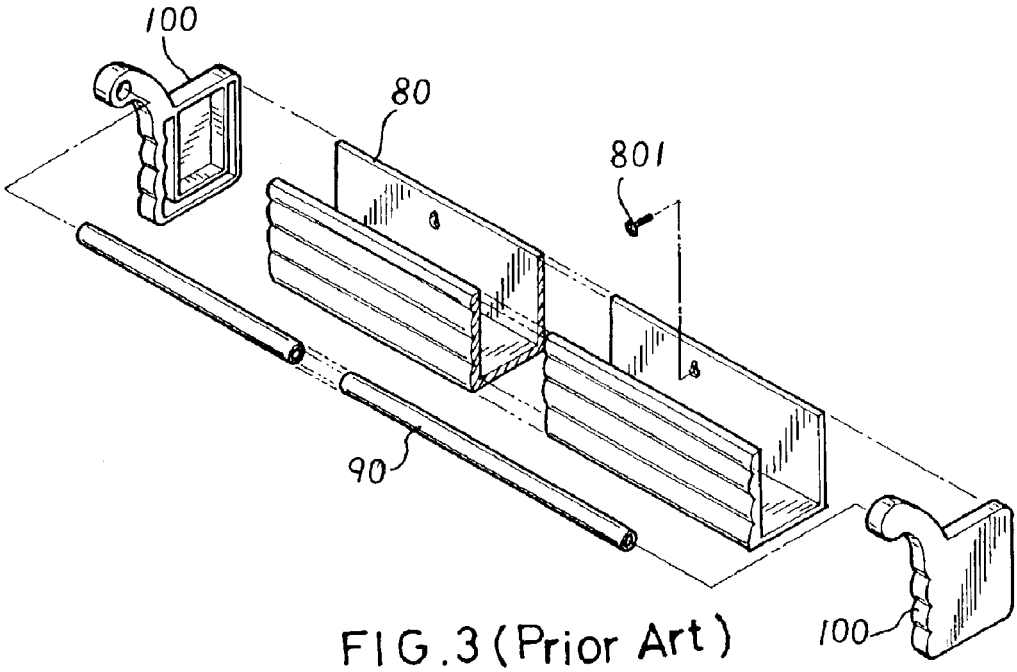
FIG.3 (Prior Art)
FIG. 3 is an exploded view of still another structure of bathroom rack according to the prior art.
Figure 4:
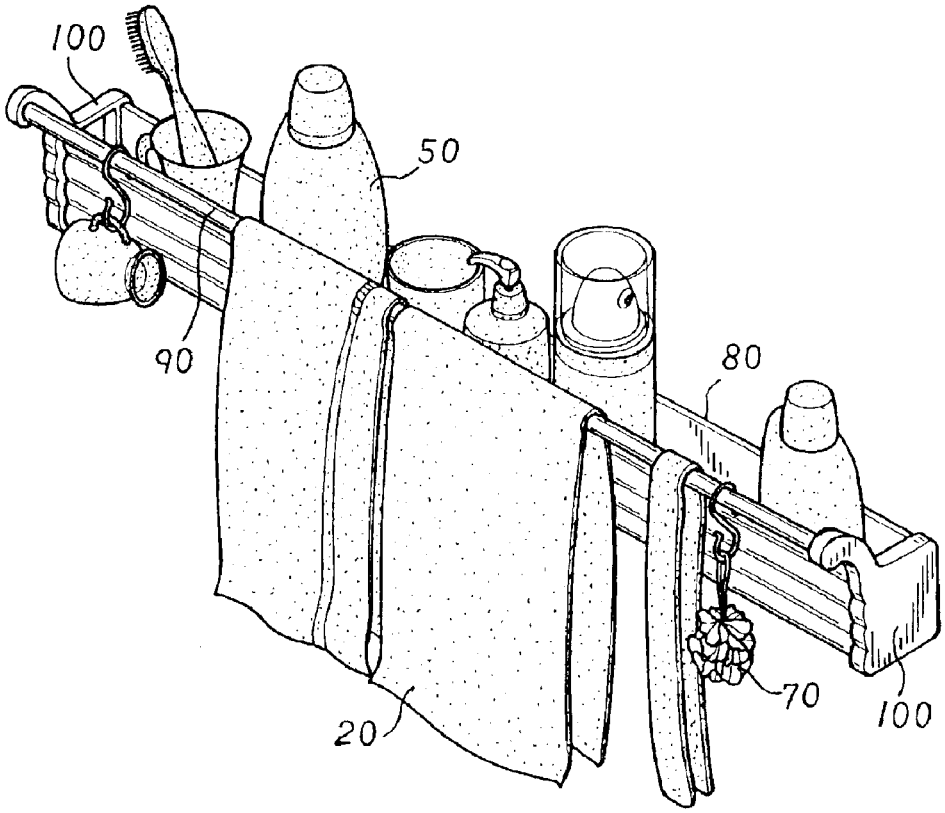
FIG.4 (Prior Art)
FIG. 4 shows an application example of the bathroom rack shown in FIG. 4.
Figure 5:
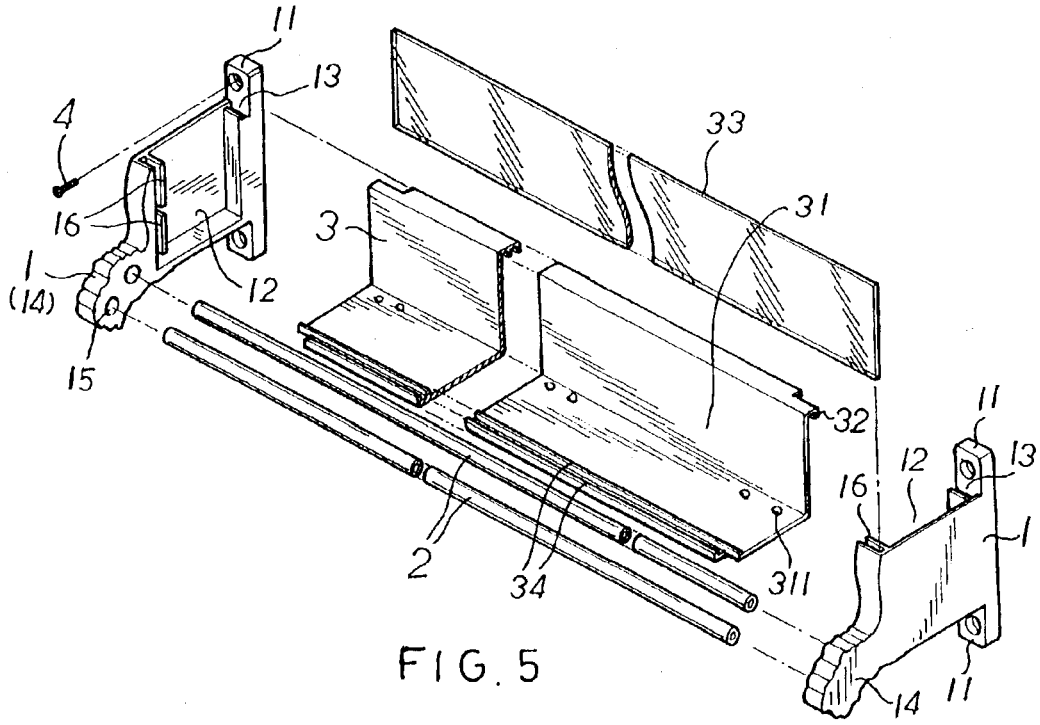
FIG. 5 is an exploded view of a bathroom rack according to the present invention.
Figure 6:
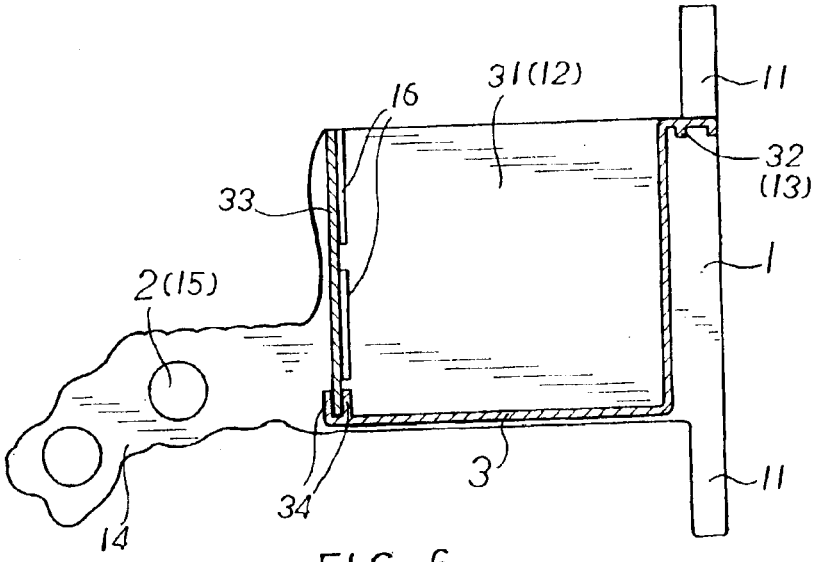
FIG. 6 is a sectional end view in an enlarged scale of the bathroom rack shown in FIG. 5.

Referring to FIGS. 5 and 6, a bathroom rack in accordance with the present invention is shown comprised of two end brackets 1, two rod members 2, and a rack body 3.

Each end bracket 1 comprises a mounting plate 11 vertically disposed at the back side for fastening to the wall by screw nails 4 or the like, a recessed receiving portion 12 formed in one lateral side on the middle and adapted to support one end of the rack body 3, a locating groove 13 formed in the mounting plate 11 near the top and facing the recessed receiving portion 12, a front extension arm 14 forwardly extended from the bottom side of the recessed receiving portion 12, two lugs 16 respectively suspended in the recessed receiving portion 12 at different elevations and defining with the peripheral wall of the recessed receiving portion 12 a narrow gap, and two plugholes 15 formed in one lateral side of the front extension arm 14. The rod members 2 are respectively press-fitted into the plugholes 15, and connected in parallel between the end brackets 1. The rack body 3 is comprised of an elongated bearing frame 31 of substantially L-shaped cross section, and a transparent front baffle 33. The bearing frame 31 has two distal ends respectively fitted into the recessed receiving portions 12 of the end brackets 1, two top locating rods 32 respectively extended from the two distal ends at the back side and respectively engaged into the locating grooves 13 of the end brackets 1, a plurality of drain holes 311 cut through the bottom wall, and two longitudinal rails 34 arranged in parallel at the front side. The transparent front baffle 33 is inserted into the recessed receiving portions 12 of the end brackets 1 and the gap in between the longitudinal rails 34 of the bearing frame 31 and supported in vertical by the lugs 16 of the end brackets 1. According to this embodiment of the present invention, the front baffle 33 is an elongated flat plate member.

Figure 9:
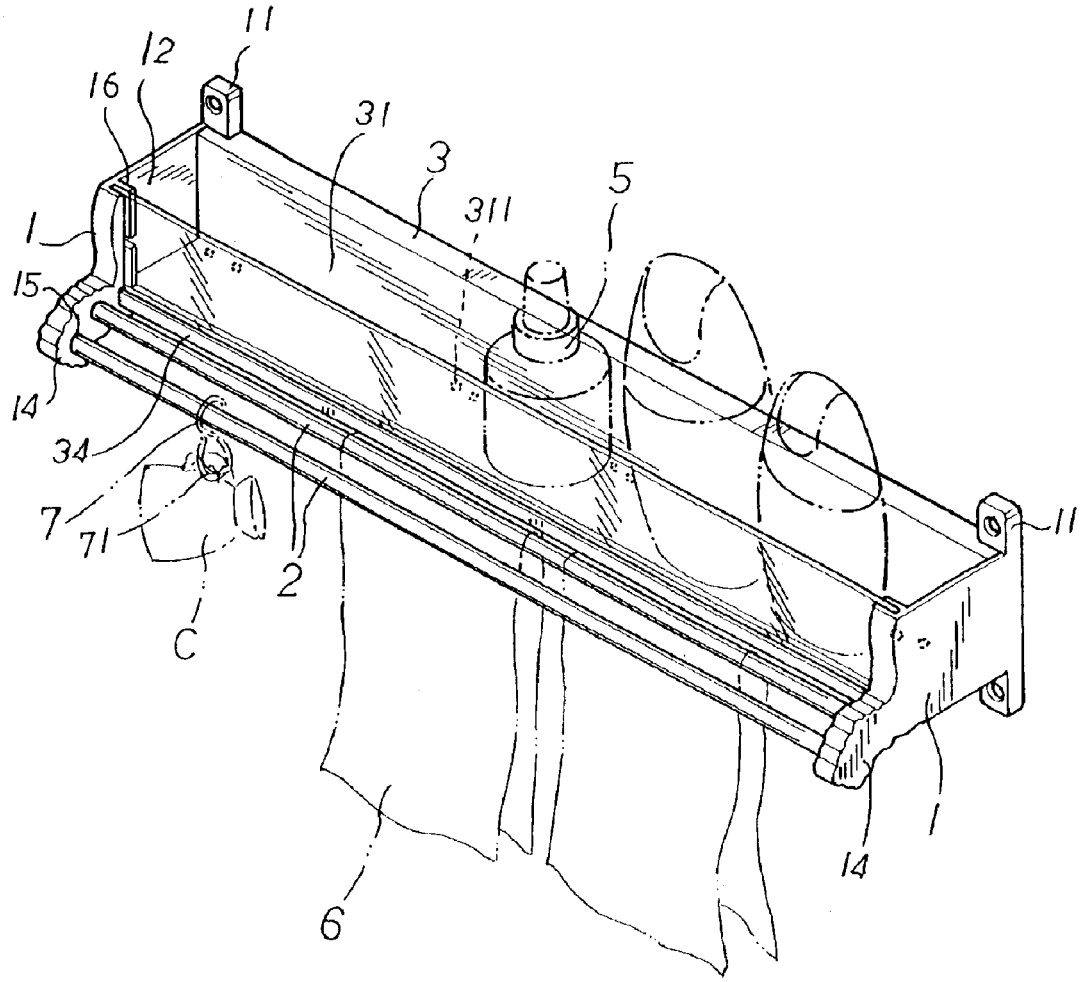
FIG. 9 shows an application example of the bathroom rack shown in FIG. 5.

Referring to FIG. 9, when the bathroom rack installed in the wall of the bathroom, bottle items (bottle shampoo, bottle hand wash, bottle body lotion, etc.) 5 can be put in the holding space defined between the bearing frame 31 and the front panel 33, towels 6 can be directly hung on the rod members 2, and cups C can be hung on the rod members 2 by hooks 71.

Figure 7:
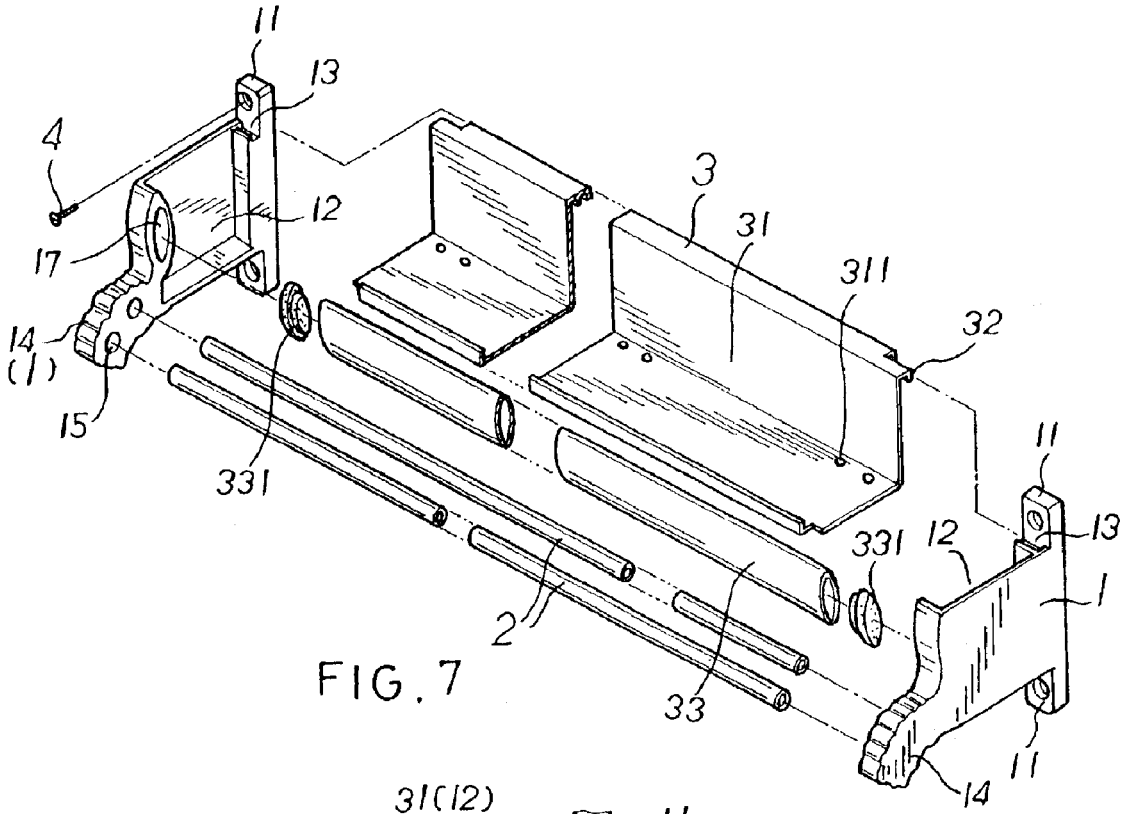
FIG. 7 is an exploded view of an alternate form of the bathroom rack according to the present invention.
Figure 8:
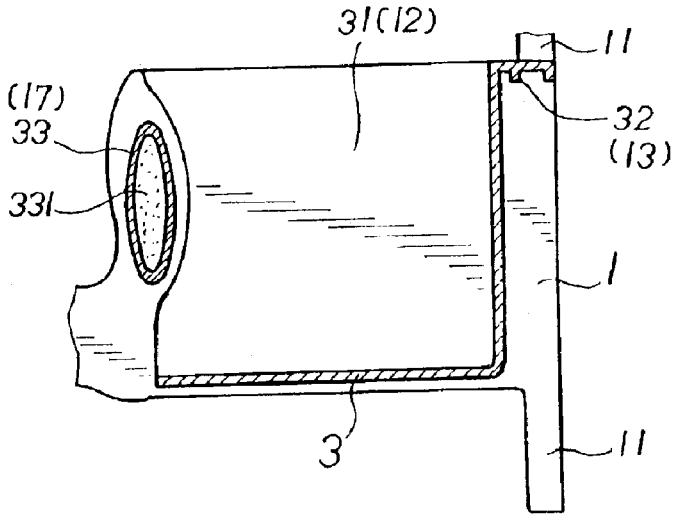
FIG. 8 is a sectional end view in an enlarged scale of the bathroom rack shown in FIG. 7.

FIGS. 7 and 8 show an alternate form of the present invention. According to this embodiment, the transparent front baffle 33 is a tubular member having two ends respectively fastened with a respective end cap 331 and then respectively plugged into a respective coupling hole 17 in each of the end brackets 1.

Figure 10:
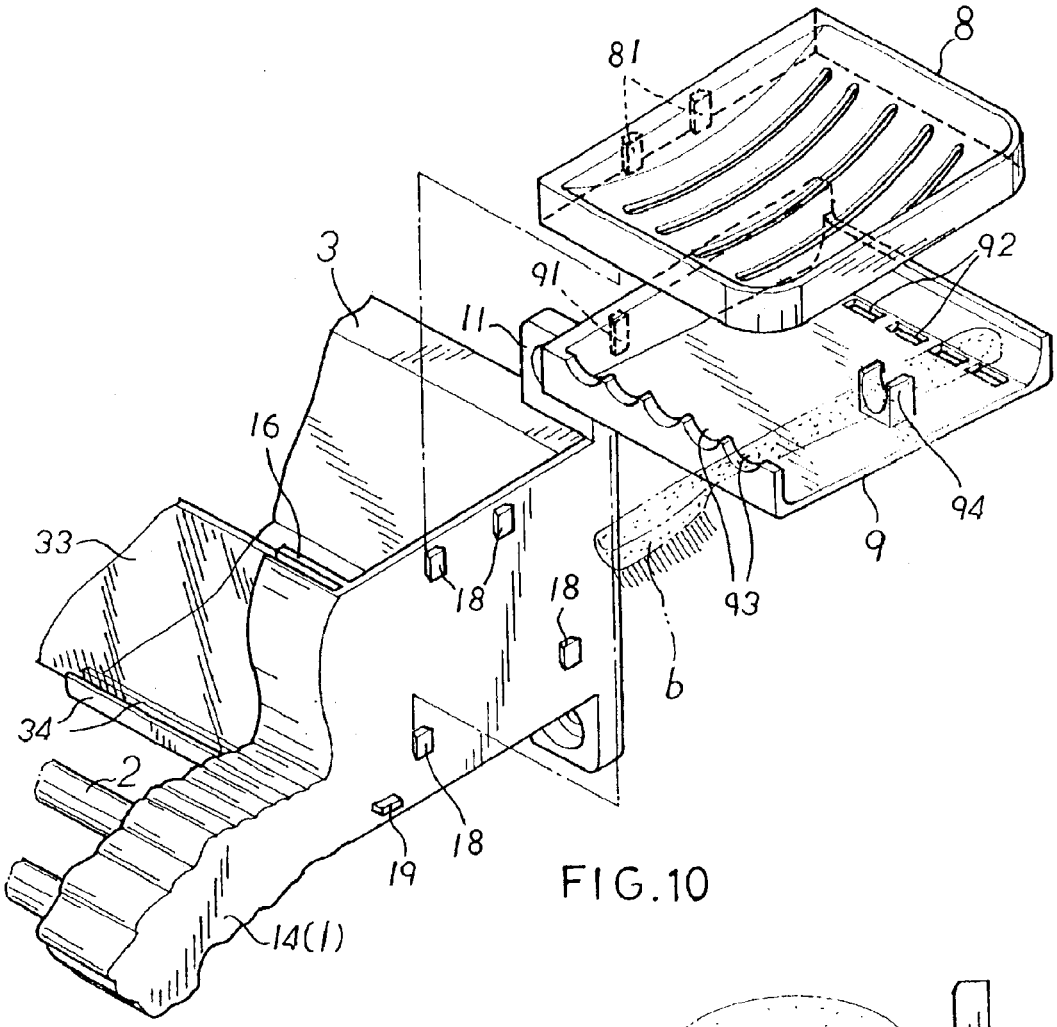
FIG. 10 is an exploded view of a part of still another alternate form of the bathroom rack according to the present invention.
Figure 11:
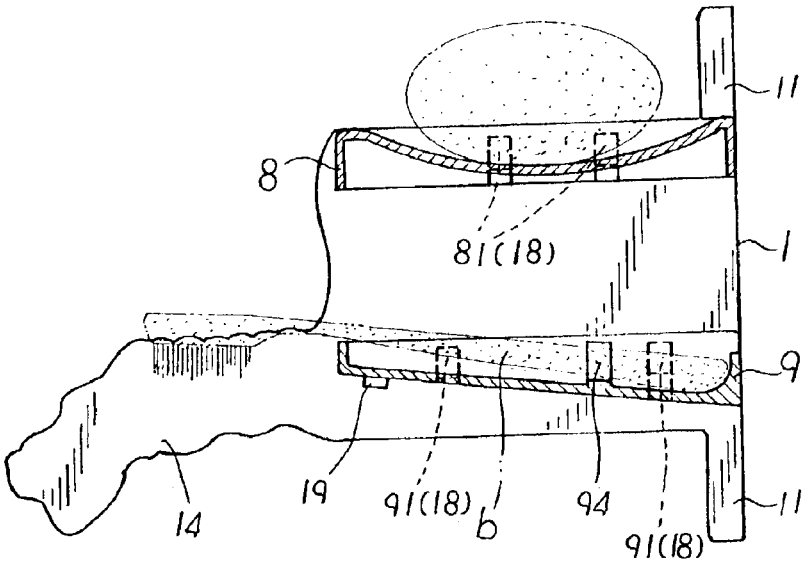
FIG. 11 is a sectional end view of FIG. 10 after loading of a cake of soap in the soap case.

FIGS. 10 and 11 show still another alternate form of the present invention. According to this embodiment, a soap case 8 and a brush case 9 are fastened to one end bracket 1. The end bracket 1 comprises a plurality of coupling lugs 18 and a supporting block 19. The soap case 8 and the brush case 9 each have a plurality of coupling holes 81 or 91 respectively coupled to the coupling lugs 18. When the brush case 9 fastened to the end bracket 1, the supporting block 19 supports the brush case 9 in position. The brush case 9 comprises a plurality of drain holes 92, a series of arched recesses 93 in the upright Front wall for the resting of brushes b, and a plurality of holder blocks 94 arranged in a row on the inside corresponding to the arched recesses 93 for holding brushes b (there is only one holder block 94 shown in FIG. 10). Further, the bottom wall of the brush case 9 slope gradually downwards from the arched recesses 93 toward the drain holes 92.

Figure 12:
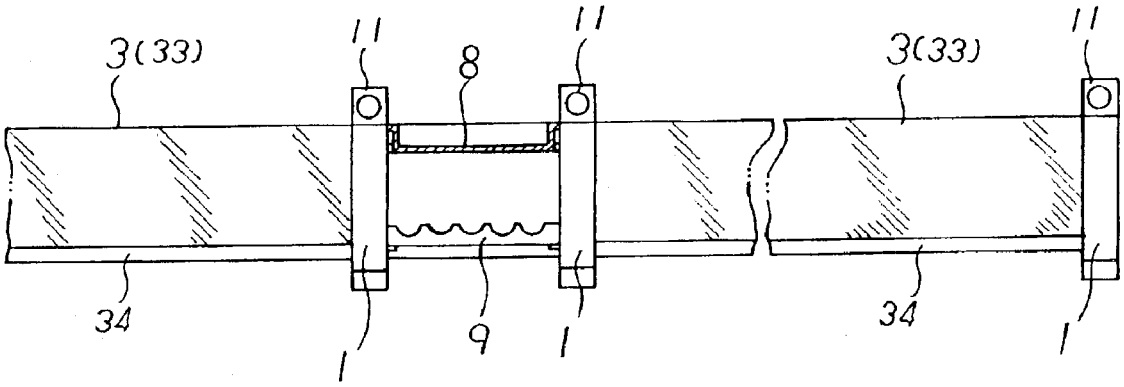
FIG. 12 is a schematic drawing showing a soap case and a brush case coupled between two bathroom racks according to the present invention.

FIG. 12 shows an installation example of the present invention in which a soap case 8 and a brush case 9 are coupled between two bathroom racks.

Figure 13:
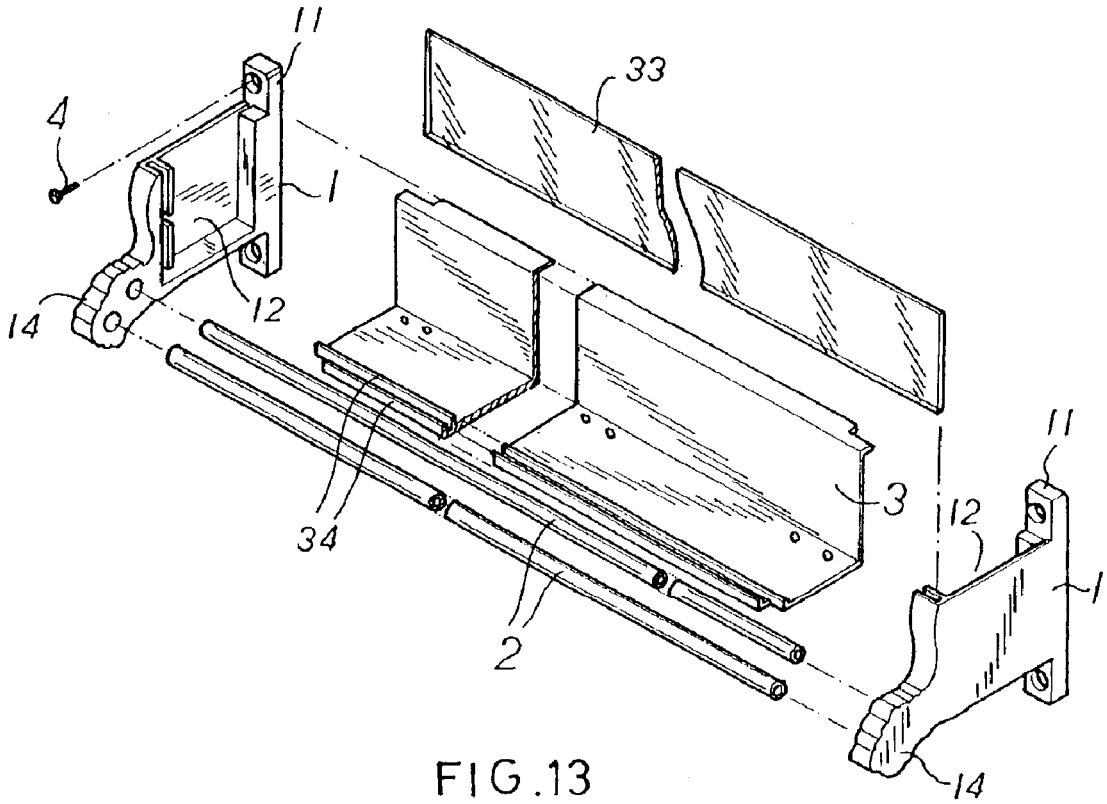
FIG. 13 is an exploded view of still another alternate form of the bathroom rack according to the present invention.

FIG. 13 shows still another alternate form of the present invention. This embodiment eliminates the aforesaid locating grooves 13 from the end brackets I and the aforesaid top locating rods 32 from the rack body 3. Directly fitting the ends of the rack body 3 into the recessed receiving portions 12 of the end brackets 1, the rack body 3 is firmly connected between the end brackets 1.

A prototype of bathroom rack has been constructed with the features of FIGS. 5~13. The bathroom rack functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A bathroom rack comprising:

two end brackets fastened to a wall of a bathroom, said end brackets each comprising a recessed receiving portion and a front extension arm, said front extension arm having at least one plughole, at least one rod member connecting said end brackets, said at least one rod member having two distal ends respectively received in one plughole of the front extension arm of each of said end brackets, and a rack body connecting said end brackets, said rack body comprising an elongated bearing plate, said elongated bearing plate having an L-shaped cross section, a plurality of drain holes in a bottom wall thereof, and two distal ends respectively received in the recessed receiving portion of each of said end brackets; wherein said rack body further comprises a transparent baffle connecting said end brackets and supported on a front side of said elongated bearing plate, said end brackets each have a plurality of retaining lugs suspended in a recessed receiving portion and adapted to hold down said transparent baffle.

2. The bathroom rack as claimed in claim 1, wherein said end brackets each further comprise at least one locating groove, and said elongated bearing plate has a plurality of locating rods respectively extended from the two distal ends and respectively engaged into the at least one locating groove of said end brackets.

3. The bathroom rack as claimed in claim 1, wherein said retaining lugs are situated at different elevations.

4. The bathroom rack as claimed in claim 1, wherein said elongated bearing plate has two longitudinal rails arranged in parallel at a front side thereof, and said transparent baffle has a bottom side fitted in between said longitudinal rails.

5. The bathroom rack as claimed in claim 1, wherein said end brackets each further comprise a coupling hole, and said rack body further comprises a transparent front baffle connecting said end brackets and supported on a front side of said elongated bearing plate, said transparent front baffle having two distal ends received in the coupling holes of said end brackets.

6. The bathroom rack as claimed in claim 1, wherein at least one of said end brackets is equipped with a soap case and a brush case, said soap case and said brush case each having coupling holes coupled to respective coupling lugs on a corresponding end bracket, said brush case comprising a plurality of drain holes, a series of arched recesses in an upright front wall thereof to receive brushes, and a plurality of holder blocks arranged in a row in positions corresponding to said arched recesses, and a bottom wall sloping gradually downward from said arched recesses toward the drain holes of said brush case.

* * * * *